US005495557A

United States Patent [19]

Hyman et al.

[11] Patent Number: 5,495,557

[45] Date of Patent: Feb. 27, 1996

[54] ELECTRONIC TOY FOR FORMING SENTENCES

[76] Inventors: Greg Hyman, 377 Cross Pon Rd., Rte. 2, Pound Ridge, N.Y. 10576; Lawrence Reiner, 1 Horizon Rd., Fort Lee, N.J. 07024

[21] Appl. No.: 294,436

[22] Filed: Aug. 23, 1994

Related U.S. Application Data

[63] Continuation of Ser. No. 905,275, Jun. 26, 1992, abandoned.

[51] Int. Cl.[6] ..... G10L 9/00

[52] U.S. Cl. ..... 395/2.81; 395/2.79

[58] Field of Search ..... 446/143, 175, 446/397; 369/63, 66; 434/167, 172, 169; 395/2.79–2.81

[56] References Cited

U.S. PATENT DOCUMENTS

| | | | |
|---|---|---|---|
| 4,451,911 | 5/1984 | Klose et al. | 369/66 |
| 4,785,420 | 11/1988 | Little | 395/2.8 |
| 4,857,030 | 8/1989 | Rose | 446/303 |
| 5,097,425 | 3/1992 | Baker et al. | 395/2.8 |
| 5,145,447 | 9/1992 | Goldfarb | 369/63 |
| 5,147,237 | 9/1992 | Kwan et al. | 446/297 |
| 5,209,665 | 5/1993 | Billings et al. | 446/143 |

OTHER PUBLICATIONS

Store Directory Instructions, Mall Madness, 6 pages, by Novel Idea Books, Dec. 1992.

Western Publishing Co., Brochure entitled "The Silly Story Teller" under the brand name Golden Games, 1 page, Dec. 1992.

*Primary Examiner*—Allen R. MacDonald
*Assistant Examiner*—Michelle Doerrler
*Attorney, Agent, or Firm*—Darby & Darby

[57] ABSTRACT

An electronic toy which enunciates words or phrases corresponding to sentence parts and a complete sentence by enunciating sounds corresponding to words of phrases selected from a plurality of addresses of a first memory representing audio data corresponding to such words or phrases arranged in each of a plurality of categories. The selected words or phrases correspond to different parts of speech, such as subjects, verbs, adjectives, direct objects and prepositional phrases. The selections are assembled in the second memory and enunciated. The toy may resemble a book in appearance and has printed lettering and color graphics corresponding to the words or phrases.

16 Claims, 2 Drawing Sheets

ELECTRONIC TOY FOR FORMING SENTENCES

This is a continuation of application Ser. No. 07/905,275, filed Jun. 26, 1992 now abandoned.

BACKGROUND OF THE INVENTION

1. Field of the Invention

The present invention relates to an educational electronic toy which forms sentences and enunciates them. The toy preferably is shaped like a book and stores and displays groups of sentence fragments for selectively forming the sentences. Colorful graphics, associated with each sentence fragment, may also be provided.

2. Discussion of Related Art

Children have used educational toys to learn vocabulary, spelling and reading skills. While such toys are geared primarily for children, they may be used by adults as well who are learning a second language. Typically, the educational toys have relatively few different variations, any of which are selectable at will. Thus, the teachings eventually become predictable and repetitious. As a result, the child (or adult) loses interest and the educational value of the device diminishes accordingly.

It would be desirable to provide an educational toy of this type that avoids predictability, so as to maintain the person's interest.

SUMMARY OF THE INVENTION

The present invention is directed to an electronic toy for forming sentences. The toy includes an electronic circuit having a permanent memory storing signals indicative of sentence fragments (in the form of words or phrases) which are grouped together according to parts of speech or grammar categories in the sentence, a temporary memory for storing sentence fragments selected from the permanent memory in a particular order for forming the sentence, circuitry for randomly selecting the sentence fragments, and an enunciator for enunciating the completed sentences composed by combining the selected sentence fragments which were stored in the temporary memory.

Preferably, the electronic circuit forms each sentence in response to activation of switches by cyclically selecting a sentence fragment from its grammar category and arranging the selections in the particular order to form a sentence. For instance, a typical sentence is composed of different parts of speech or grammar categories, i.e., a subject, an adverb, a verb, an adjective, a direct object, an indirect object and a prepositional phrase. Signals, indicative of words or phrases, are stored in the permanent memory in association with each of the grammar categories. By activating an appropriate switch, a word or phrase grouped under a particular grammar category is selected and stored in the temporary memory. When selections have been completed for each of the grammar categories, a predetermined order of them forms a complete sentence. Signals indicative of sounds corresponding to the selected words or phrases are stored and may be retrieved for enunciation in that predetermined order so as to enunciate the complete sentence.

As an additional educational benefit, each sentence fragment may be printed on a housing containing the electronic circuitry so as to visually present the full range of the lettering of words or phrases from which selection will be made. Further, colorful graphics associated with each sentence fragment may also be illustrated next to the associated, printed sentence fragment.

BRIEF DESCRIPTION OF THE DRAWINGS

For a better understanding of the present invention, reference is made to the following description and accompanying drawings, while the scope of the invention is set forth in the appended claims.

DESCRIPTION OF THE PREFERRED EMBODIMENT

Figure 1:
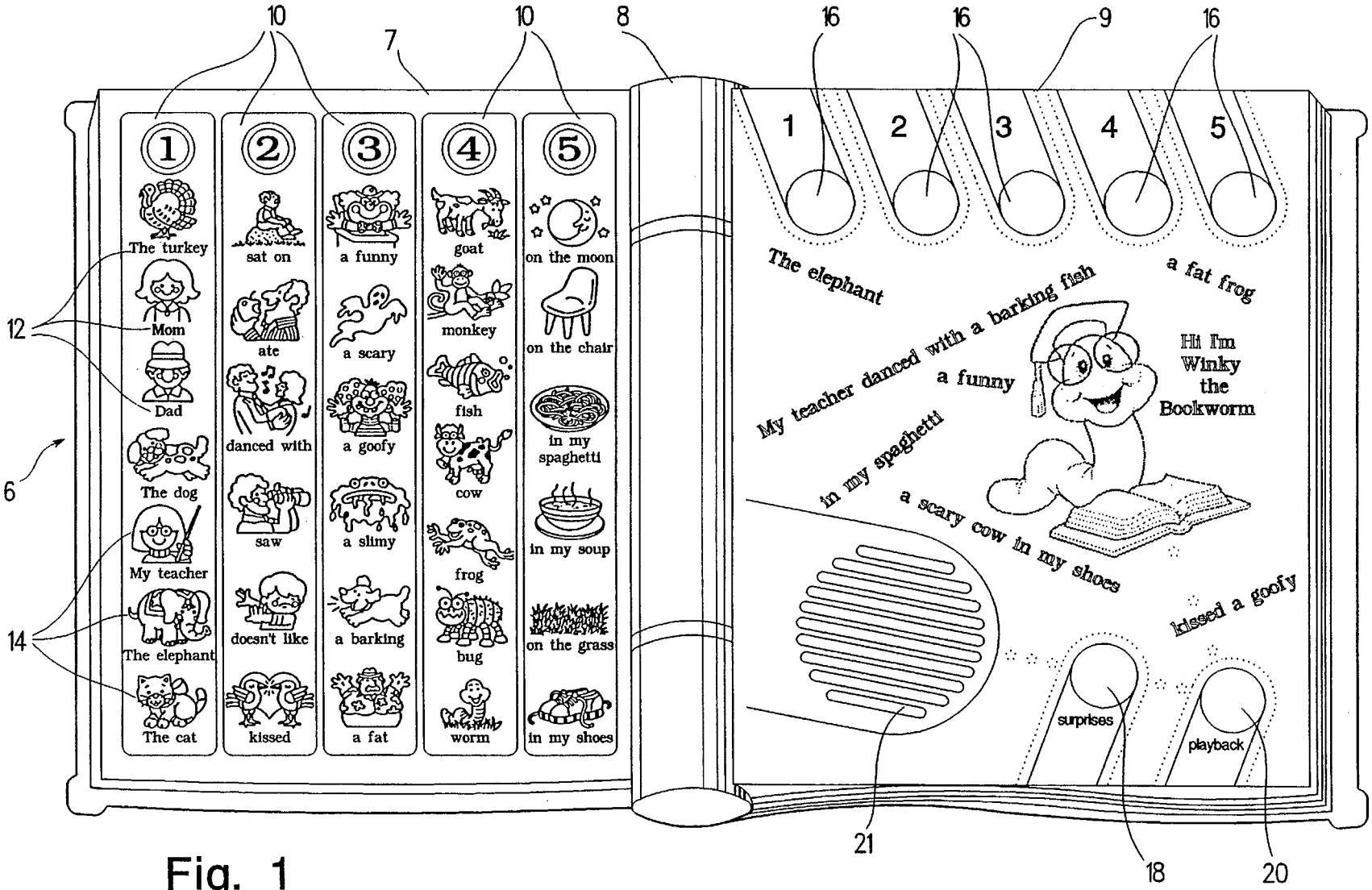
FIG. 1 is a top, partially perspective, view of the present invention in a form resembling that of a book, shown in an open position.

Referring to FIG. 1, the present invention has a housing 6 which resembles a book having left 7 and right 9 open faces. A hinge connection 8 may be provided between the faces 7, 9 at the 'binding' of the book to allow the faces 7, 9 to rotate relative to each other about an axis passing longitudinally through the hinge connection 8. The hinge connection 8 may include two outer cylindrical portions and one inner cylindrical portion between the two outer cylindrical portions. The two outer cylindrical portions are secured to the front cover which has the left open face 4 and the inner cylindrical portion is secured to the back cover which has the right open face 9. The inner cylindrical portion may have a longitudinal projection extending from each of its ends and each of the outer cylindrical portions may have a respective slot or recess engaging a respective one of the two rings to permit relative rotation of the projections with respect to the slots or recesses. The housing 6 comprising the portions 7, 9 and 8 may be made of a durable plastic.

The left open face 6 is shown with word columns 10, each numbered and representing a different part of speech, i.e., subject, verb, adjective, direct object, prepositional phrase. Other forms of speech, such as adverbs, may also be added as desired during initial formation.

Each column 10 has a respective group of different sentence fragments 12 in the form of words or phrases. Each column represents a particular part of speech or grammar category. The columns are arranged in a particular order, i.e., the order in which the sentence is to form when combining a selected one of the sentence fragments for each of the grammar categories with the selected ones of the sentence fragments for each of the other categories and enunciating them in succession. The sentences, while shown here in English to be read from left to right, may be provided in any language and arranged in the order in which they are to be read in that language, e.g., in column form to be read from right to left or in row form to be read from top to bottom.

Color graphics 14 are provided in association with and next to each of the sentence fragments 12. The color graphics is indicative of the associated sentence fragment.

The right open face 9 contains accessible word buttons which may be depressed for activating selection by electronic circuitry within the housing 6. For example, buttons 16 are each used for selecting a sentence fragment from a corresponding speech or grammar category. Pressing any button 16 results in the random selection of one of the sentence fragments under the associated grammar category and also the enunciation of the same. Playback button 20 is used for enunciating the complete sentence composed of the individually randomly selected sentence fragments from each of the columns 1, 2, 3, 4, 5 selected by the user. Pressing button 18 causes automatic random selection of a sentence fragment in each of the columns 1, 2, 3, 4 and 5 in succession so as to form an entire random sentence and enunciation of the same. Enunciation is heard through slots 21 in the right open face 9 over a loud speaker 26 (see FIG. 2).

Figure 2:
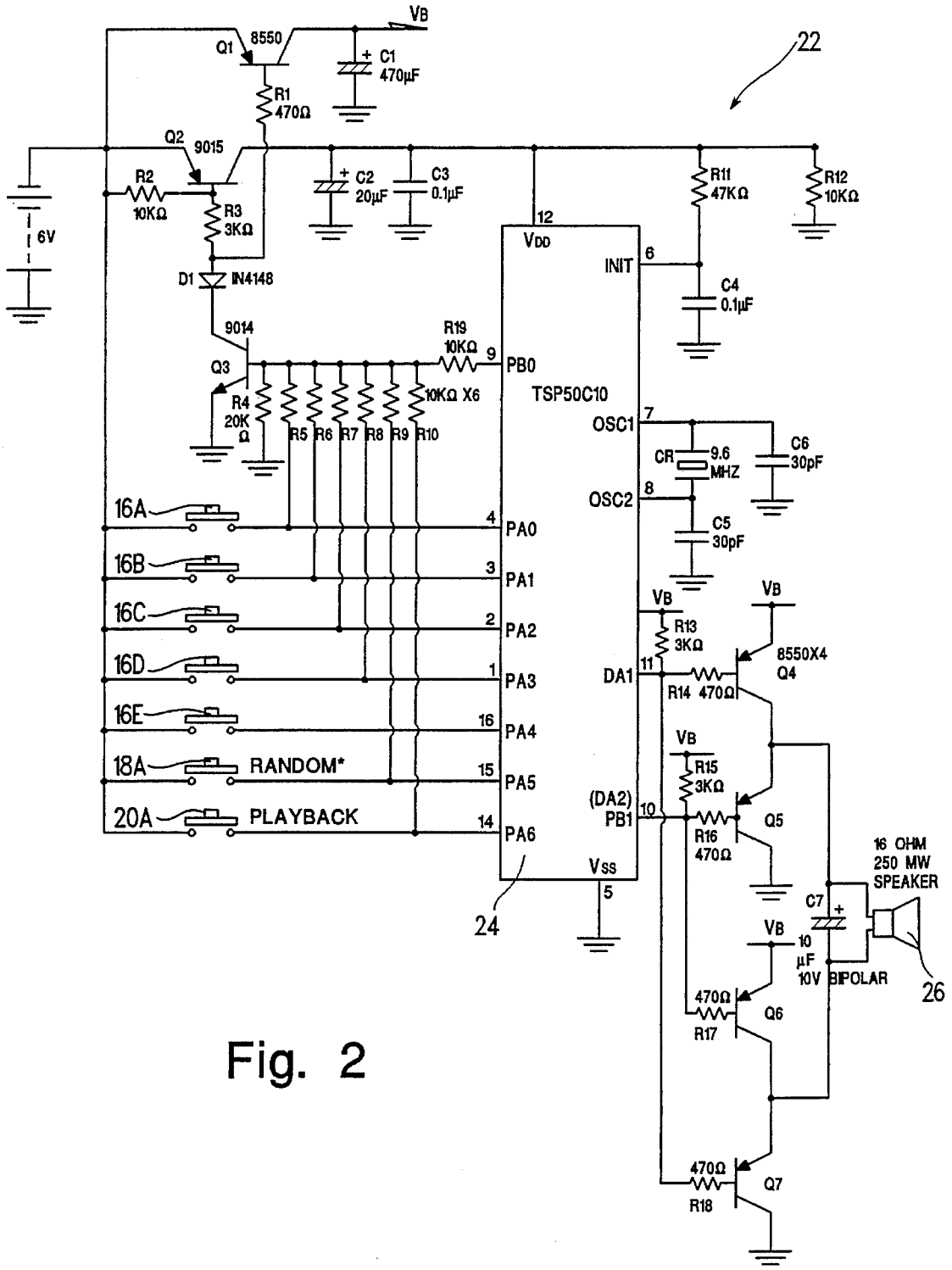
FIG. 2 is a schematic of the electronic circuitry employed in the invention of FIG. 1.

The electronic circuitry 22 shown in schematic form in FIG. 2 is contained within the housing 6.

An integrated circuit 24 (IC), exemplified by Texas Instruments TSP50C10, is a combination speech digitizer and microprocessor integrated circuit that is capable of playing back pre-recorded words accessed under control of a software program. Both the words and the software program are mask programmed into the ROM (read only memory) of the TSP50C10. The IC operates from a 6 volt power supply made up of four 1.5 volt "AA" batteries. The IC is controlled by the following seven momentary pushbutton switches:

Switches 16 A–E each select a word or phrase to be used in making up the "story" and are activated in response to pressing of associated word buttons 16 of FIG. 1.

RANDOM Switch 18A causes a random "story" to be made-up and played back, without the requirement to first press Switches 16 A–E to select the words or phrases in the "story". Random Switch 18A activates in response to pressing button 18 of FIG. 1.

PLAYBACK Switch 20A causes the entire made up "story" to be played back in response to each time the PLAYBACK button 20 (FIG. 1) pressed.

Transistors Q1-3, diode D1, capacitors C1-4 and resistors R1-12, R-19 comprise a power-on and reset circuit that is activated when any one of the seven switches is pressed. A signal from pin 9 of the IC keeps power applied to the IC following the first button depression. If no button is pressed for a preprogrammed amount of time (about 3 minutes) the signal from pin 9 will cease and power to the IC will be removed, thus turning it off.

Capacitors C5-6 and ceramic resonator CR set the 9.6 Mhz. oscillator frequency of the IC. Transistors Q4-7, capacitor C7 and resistors R13-18 comprise an audio amplifier that drives the 16 ohm speaker 26 which produces the sounds generated by the IC.

A typical operation initiated by a child is as follows:

The child may first decide which of the sentence fragments associated with the lettering and color graphics is to be enunciated in a given column. To achieve this, the child continues to press the button 16 associated with that column (category) until the desired selection, i.e., sentence fragment, is enunciated. Note that the child may press each of the buttons 16 in any order, each button being associated with a respective one of the columns 10 for a particular part of speech. After each press, the sentence fragment corresponding to the associated particular part of speech or grammar category is enunciated and stored. As an aid in correlating the buttons with the columns, the buttons 16 are each of a different color and color coordinated with an associated column 10 and also numbered in correspondence as shown.

After each of the buttons 16 have been pressed and the desired sentence fragment corresponding to each category (column) individually enunciated and stored, button 20 is pressed to enunciate the complete sentence in the proper grammatical order. The child may follow the lettering and color graphics associated with each part of speech or grammar category as the sentence is being enunciated. If desired, the playback button 20 may be pressed again to repeat the selected sentence assembled from the individually selected segments.

The order in which the buttons 16 are pressed makes no difference; the sentence which is enunciated will always be done in the proper grammatical order in accordance with the printing on left face, i.e., subject-verb-adjective-direct object-prepositional phrase. The next time any button 16 is pressed, the next sentence fragment in the category corresponding to the depressed button 16 is enunciated and stored.

The process of depressing the various buttons 16 may be repeated by the child to form a new sentence, as desired. Whatever new sentence fragment is selected by depressing each button is stored and replaces its previously stored counterpart in the temporary memory. If only some of the buttons 16 are pressed for forming a new sentence and the playback button 20 is then pressed, the sentence enunciated will include the sentence fragments corresponding to those newly selected and will fill in the missing sentence fragments with those previously stored in temporary memory for the last sentence enunciated.

The child may opt to press button 18, which randomly selects sentence fragments from each grammar category. This random selection then replaces whatever sentence was previously stored in temporary memory and so may be enunciated again if the playback button is pressed. If the buttons 16 are pressed next, the enunciated sentence fragments will be the next ones in each column immediately following the sentence fragments enunciated for the random sentence.

In order to enhance the desirability for using the electronic toy, the enunciated sentences are humorous and somewhat imaginary, but always enunciated in correct grammatical order.

While it is envisioned that pressing the button 18 will randomly generate an entire sentence to enunciate and store a complete sentence, another embodiment would allow button 18 to instead only enunciate and store a random selection of one of the sentence fragments for each column each time button 18 is pressed. Thus, pressing button 18 five times would enunciate five randomly selected sentence fragments, one from each of the five columns. Pressing the playback button 20 would enunciate whatever sentence fragments are stored in temporary memory.

While the foregoing description and drawings represent the preferred embodiments of the present invention, it will be understood that various changes and modifications may be made without departing from the spirit and scope of the present invention.

What is claimed is:

1. An electronic toy comprising:

first memory means arrayed in a plurality of categories, each category corresponding to a part of a sentence and having a plurality of addresses, each address storing a respective and different audio data corresponding to the category sentence part;

a respective selectively activated selecting means associated with each category of said first memory means to be activated for selecting an address of the category with which the activated selecting means is associated;

means for enunciating an audio representation of the audio data of an address of a category of said first memory means in response to selection of the address by the selecting means associated with the category;

second memory means for storing each address as selected from the categories of said first memory means; and means for operating said enunciating means to also produce an audio representation of the audio data corresponding to the addresses of said first memory means categories stored in said second memory means.

2. An electronic toy as in claim 1, wherein a said selecting means of at least one category includes means for randomly selecting the first memory means address of the category associated with the said selecting means.

3. An electronic toy as in claim 1, wherein a said selecting means of at least one category includes means for cycling through in a predetermined order each of the first memory means addresses of said at least one category upon successive activation of the selecting means associated with said at least one category.

4. An electronic toy as in claim 1, wherein the categories containing the addresses include at least one category selected from a group consisting of subjects, adverbs, verbs, adjectives, direct objects, indirect objects and prepositional phrases.

5. An electronic toy as in claim 1, further comprising a housing containing all of said means; and indicia on said housing grouped in categories with a representation corresponding to each of the sentence parts of each of the addresses of a respective category, the indicia displayed as readable words or phrases.

6. An electronic toy as in claim 5, further comprising a plurality of graphic images on the housing each corresponding to an associated one of the indicia.

7. An electronic toy as in claim 5, wherein the housing resembles a book having a front cover element with a left side page, a back cover element with a right side page, and a book binding connecting the front and back cover elements.

8. An electronic toy as in claim 1, further comprising a housing containing all of said means; and each said selecting means comprising a respective switch means displaceable between operative and inoperative positions being moved to said operative position for effecting the selecting of an address of said first memory means and being biased to be displaced into the inoperative position.

9. An electronic toy as in claim 1 wherein said operating means operates said enunciating means to produce an audio representation of the audio data of the selected first memory means address of each of the categories stored in said second memory means.

10. An electronic toy as in claim 9 wherein the selecting means associated with each category operates upon successive activation to sequentially cycle through the addresses of said first memory means of the corresponding category to produce sequential enunciation of the audio data of each of the selected addresses and sequential storing of each of the selected addresses in said second memory means.

11. An electronic toy as in claim 9 wherein said second memory means continues to store a selected address of a said first memory means category as selected by the activation means associated with a category until the address stored is changed by further activation of a selecting means associated with the category, said operating means upon activation operates said enunciating means to produce an audio representation of the audio data of the first memory means address of each of the categories as stored in said second memory means as updated for any category by the further activation of a selecting means for each category and producing an audio representation of the first memory means address already stored in said second memory means of a category whose selecting means was not activated prior to the operation of said operating means to cause said enunciation means to enunciate the audio data corresponding to the addresses stored in said second memory means.

12. An electronic toy as set forth in claim 1 wherein said operating means operates said enunciating means to produce an audio representation of the audio data of each of the first memory means addresses stored in said second memory in a predetermined sequence without regard to the sequence of the activation of the selecting means associated with each of the categories.

13. An electronic toy as in claim 1 wherein said first memory means has a predetermined number of addresses for each category.

14. (Amended) An electronic toy as in claim 1 wherein the selecting means associated with at least one of the categories upon successive activation sequentially cycles through the addresses of the corresponding category of said first memory means associated with the activated selecting means and produces sequential enunciation of the audio data of the sequentially selected addresses and sequential storing of the sequentially selected addresses in said second memory means.

15. An electronic toy as in claim 1 wherein the audio data to be reproduced is a sentence, and said operating means produces an audio representation of the audio data corresponding to the addresses of said first memory means stored in said second memory means to enunciate a complete sentence.

16. An electronic toy as set forth in claim 1 wherein a selecting means for each of said categories includes means for randomly selecting an address of the category of said first memory means with which a selecting means is associated and which randomly selected address is stored in said second memory means and the audio data corresponding thereto is enunciated.

* * * * *